United States Patent [19]

Routsis

[11] Patent Number: 4,851,093

[45] Date of Patent: Jul. 25, 1989

[54] SELECTIVE DECOMPOSITION OF A CHROMIUM CARBIDE COATING FROM A CHROMIUM CARBIDE COATED NICKEL ALLOY SUBSTRATE

[75] Inventor: Kostas Routsis, East Hartford, Conn.

[73] Assignee: United Technologies Corporation, Hartford, Conn.

[21] Appl. No.: 203,391

[22] Filed: Jun. 6, 1988

[51] Int. Cl.[4] ..... C25F 5/00

[52] U.S. Cl. ..... 204/146

[58] Field of Search ..... 204/146

[56] References Cited

U.S. PATENT DOCUMENTS 4,128,463 12/1978 Formanik ..... 204/146

4,234,333 11/1980 Ghandehari et al. ..... 75/0.5

4,234,397 11/1980 Torrey ..... 204/129.35

4,246,083 1/1981 Notton ..... 204/146

4,261,804 4/1981 McGivern, Jr. ..... 204/146

4,385,972 5/1983 Vanderpool ..... 204/146

*Primary Examiner*—T. M. Tufariello

*Attorney, Agent, or Firm*—Kevin E. McVeigh

[57] ABSTRACT

A stripping process for the removal of plasma spray applied chromium carbide-nickel chromium coatings from nickel base alloy substrates is disclosed. The coating is decomposed electrolytically by immersing the coated substrate in an alkaline metal hydroxide solution to form the anode of an electrolytic cell and imposing a potential difference across the cells sufficient to decompose the coating without affecting the substrate.

3 Claims, 1 Drawing Sheet

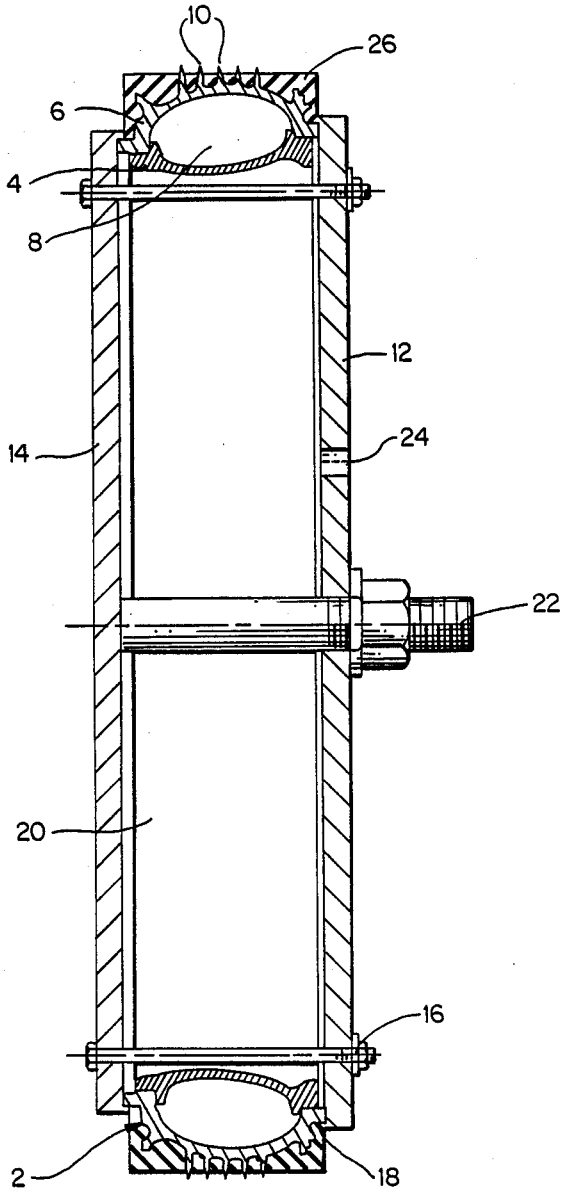
10
26
6
4
8
12
14
24
22
20
16
2
18

SELECTIVE DECOMPOSITION OF A CHROMIUM CARBIDE COATING FROM A CHROMIUM CARBIDE COATED NICKEL ALLOY SUBSTRATE

TECHNICAL FIELD

The field of art to which this invention pertains is the removal of metal coatings.

BACKGROUND ART

Plasma sprayed chromium carbide is a highly wear resistant coating which may be applied to nickel alloy gas turbine engine parts to extend the operating life of the parts. The carbide coating may be damaged during engine operation. If only the coating is damaged, the part may be salvaged by removing the damaged coating and applying new coating.

Several processes have been used for removing the plasma sprayed chromium carbide coating, each of which suffers from certain disadvantages. Grit blasting may damage the underlying substrate beyond repair. Mechanical grinding is prohibitively expensive. Molten salt stripping at 800° F. to 900° F. is effective in removing the coating, however, the molten salt is very difficult to remove from hollow parts and parts with complex geometries. Anodic stripping in a solution of sodium carbonate and sodium tartrate is quite slow and the removal is often incomplete. Stripping in a hot chromic acid solution is very rapid, however, there is intergranular attack on the substrate material. Finally, stripping in a hot solution of sodium hydroxide and potassium permanganate is rather messy in that a great deal of magnesium oxide precipitate forms.

What is need in the art is a process for removing plasma sprayed chromium carbide coatings from nickel alloy substrates without affecting the substrate material which overcomes the above difficulties.

DISCLOSURE OF INVENTION

A process for the selective removal of chromium carbide coating from a chromium carbide coated nickel alloy substrate is disclosed. Process comprises immersing the coated substrate in an alkaline metal hydroxide solution to form the anode of an electrolytic cell, imposing a difference in electrical potential across the cell, sufficient to decompose the coating to form a layer of decomposition products on the substrate without affecting the substrate, and removing the layer of decomposition products from the substrate.

BRIEF DESCRIPTION OF DRAWINGS

The Figure shows a cross-sectional view of a gas turbine engine seal assembly that is fixtured for the removal of a chromium carbide coating by the process of the process invention.

BEST MODE FOR CARRYING OUT THE INVENTION

The method of the present invention is useful in the removal of chromium carbide coatings from nickel based alloy substrates.

The chromium carbide coatings which may be removed by the method of the present invention include plasma spray applied chromium carbide coatings in which chromium carbide regions are held together by a metal alloy binder such as, for example, a plasma spray applied chromium carbide nickel chromium coating.

The method of the present invention is useful in removing the coating materials discussed above from nickel base alloy substrates without affecting the substrate material. Suitable substrate materials include, for example, Inconel 718 (nominal composition, 19 wt % Cr, 0.05 wt % C, 18 wt % Fe, 0.9 wt % Ti, 0.6 wt % Al and 3.0 wt % Mo, remainder Ni), Inconel 600 (nominal composition, 15.5 wt % Cr, 8.0 wt % Fe, remainder Ni) or Improved IN-100 (nominal composition, 12.4 wt % Cr, 18.5 wt % Co, 0.025 wt % C, 4.3 wt % Ti, 5.0 wt % Al, 3.2 wt % Mo, remainder Ni).

The chromium carbide coated nickel alloy substrate is immersed in an aqueous electrolytic solution and made the anode of an electrolytic cell.

The electrolytic solution comprises an aqueous solution of a metal hydroxide. Sodium hydroxide, potassium hydroxide and lithium hydroxide are suitable soluble alkaline metal hydroxides. Sodium hydroxide is the preferred soluble metal hydroxide. The solution comprises between 100 and 200 grams per liter alkaline metal hydroxide, preferably comprises between 120 and 150 grams per liter soluble metal hydroxide and most preferably comprises about 135 grams per liter soluble metal hydroxide.

It should be noted that the chloride content of the solution must be maintained below about 10 ppm to prevent attack of the nickel alloy substrate during the electrolysis process.

A difference in electrical potential is imposed across the cell. The difference in electrical potential is between 4 and 8 volts and is preferably about 6 volts. Potential differences of less than 4 volts are undesirable because of the long processing time required at lower voltages, and potential differences of greater than 8 volts are undesirable because of excessive heat generation.

The current flow varies with the surface area of the area being stripped. The current density is typically in the range of about 5 amps/in$^2$ to about 10 amps/in$^2$, based on the surface area of the area being stripped. Surfaces which do not require stripping may be masked with a suitable masking material to reduce the surface area in contact with the electrolyte solution and reduce the current required.

The process is allowed to continue for a time period of about 4 hours to about 50 hours, depending upon the thickness of chromium carbide coating to be removed. For example, a 0.006 inch thick coating may be removed in about 36 hours using the process of the present invention.

The temperature of the electrolytic solution is allowed to vary from between ambient temperature up to 180° F. It is preferred that the temperature of the electrolytic solution be maintained below 130° F.

The electrolysis process results in the formation of a layer of decomposition products on the surface of the substrate. The decomposition products may be removed by abrasive means such as wire brushing or wet abrasive blasting. Wet abrasive blasting, and particularly wet glass bead blasting, is preferred.

EXAMPLE I

The process of the present invention was used to remove a layer of a chromium carbide coating from the knife edges of a lenticular seal assembly for a gas turbine engine.

Referring to the figure, the lenticular seal assembly 2 comprises an inner ring 4 and an outer ring 6 which are shrink fitted together. The seal assembly is annular in shape and defines an internal void 8. Five knife edge seals 10 project radially outwardly from the outer diameter of the outer ring 4. Each of the knife edge seals 10 is coated with a 0.006 inch thick layer of plasma spray applied chromium carbide coating. The chromium carbide coating comprises 75% by weight chromium carbide and 25% by weight of a mixture of 80% by weight nickel and 20% by weight chromium. The substrate outer ring 6 comprises about 12% chromium, about 19% cobalt, about 4% titanium, about 5% aluminum and about 3.2% molybdenum.

A fixture is required to hold the seal assembly and prevent the electrolyte solution from entering the inner void 8 of the seal 2. The seal is clamped in a holding fixture and all exposed surface area other than the knife edge seals 10 are masked with masking material 26. The holding fixture comprises a steel front plate 12 with a pressure port 24 and a steel rear plate 14. The plates are coated with masking material, except for the area of each plate in direct contact with edges of the seal assembly. Nuts and bolts 16 are used to fasten the front plate 12 to the back plate 14. The seal assembly 2 and plates 12 and 14 define a chamber 20. Neoprene gaskets 18 between the seal assembly 2 and each of the plates 12 and 14 seal the chamber 20. An air line is attached to the pressure port 24. The chamber 20 is pressured to 5 psi. The fixtured seal assembly 2 is connected to a DC generator. The anode lead wire of the generator is attached to the brass rod 22 and the cathode lead wire of the generator is attached to the wall of a stainless steel stripping tank. The fixtured seal assembly is immersed in an aqueous electrolyte solution (135 g NaOH/liter) in the stripping tank. A block of insulating material, e.g. polyethylene, is placed between the bottom plate 14 and the bottom of the tank wall to prevent electrical contact between the bottom plate 14 and the tank. A difference in electrical potential of about 5 volts is imposed across the cell for a period of about 40 hours. The temperature of the electrolyte solution is maintained below 130° F. After 40 hours, the potential difference is removed, the substrate is removed from the electrolyte solution and decomposition products of the coating which have been formed on the substrate are removed by wet glass bead blasting and rinsed with tap water.

After removal of the decomposition products, the knife edges are subjected to microscopic examination to determine whether the chromium carbide coating has been completely removed.

EXAMPLE II

Three of the five knife edge seals on a lenticular seal from a PW2037 gas turbine engine were subjected to the process described in Example I for 32 hours.

Metallographic examination revealed that the chromium carbide coating was completely removed and that the substrate was not affected by the stripping process.

The process of the present invention allows the removal of plasma sprayed chromium carbide coatings from nickel based alloy substrates without affecting the substrate.

I claim:

1. A process for the selective removal of a chromium carbide coating from a chromium carbide coated nickel alloy substrate, comprising:

immersing the coated substrate in an alkaline metal hydroxide solution to form the anode of an electrolytic cell, imposing a difference in electrical potential across the cell, sufficient to decompose the coating to form a layer of decomposition products on the substrate without affecting the substrate, and removing the layer of decomposition products from the substrate.

2. The process of claim 1 wherein the solution comprises 120 grams per liter to 150 grams per liter sodium hydroxide.

3. The process of claim 1 wherein the potential difference is in the range of 4 volts to 8 volts.

* * * * *